United States Patent [19]

Lucian et al.

[11] Patent Number: 4,470,435

[45] Date of Patent: Sep. 11, 1984

[54] SELVEDGE CUTTING DEVICE FOR A WEAVING MACHINE

[75] Inventors: Anton Lucian; Rudolf Zwiener; Hugo Mueller, all of Arbon, Switzerland

[73] Assignee: Aktiengesellschaft Adolf Saurer, Arbon, Switzerland

[21] Appl. No.: 392,897

[22] Filed: Jun. 28, 1982

[30] Foreign Application Priority Data

Jul. 6, 1981 [CH] Switzerland ..... 4428/81

[51] Int. Cl.[3] ..... D03D 49/70

[52] U.S. Cl. ..... 139/429; 139/302

[58] Field of Search ..... 139/302, 303, 429, 430, 139/450, 194

[56] References Cited

U.S. PATENT DOCUMENTS

| | | | |
|---|---|---|---|
| 3,431,951 | 3/1969 | Thibault et al. | 139/450 |
| 3,489,184 | 1/1970 | Bernath | 139/302 |
| 3,530,902 | 9/1970 | Stingl | 139/302 |
| 4,071,051 | 1/1978 | Strauss | 139/194 |
| 4,320,785 | 3/1982 | Zwiener | 139/429 |

FOREIGN PATENT DOCUMENTS

| | | | |
|---|---|---|---|
| 317801 | 12/1973 | Austria . | |
| 521519 | 9/1931 | Fed. Rep. of Germany | 139/429 |
| 809655 | 8/1951 | Fed. Rep. of Germany . | |
| 2342204 | 3/1974 | Fed. Rep. of Germany . | |
| 2435397 | 1/1976 | Fed. Rep. of Germany . | |
| 300551 | 10/1954 | Switzerland . | |
| 540365 | 8/1973 | Switzerland . | |

*Primary Examiner*—Henry Jaudon

*Attorney, Agent, or Firm*—Werner W. Kleeman

[57] ABSTRACT

A selvedge cutting device for a weaving machine or loom serves to cut the selvedge from the fundamental weave or foundation fabric prior to winding-up the same and contains a scissor structure composed of two mutually contacting scissor blades. The one scissor blade is arranged at a mounting structure, such as a stationary ball pin or bowl gudgeon for carrying out swinging or pendulum movements and in relation to which mounting structure the other scissor blade is displaceable in its lengthwise extent. Both of the scissor blades form, at the region of their cutting edges, guide surfaces for the self-guiding of the scissor structure in a cutting lane or alley at the fabric. At the displaceable scissor blade there engages a drive which imparts to such scissor blade an up-and-down movement and does not hinder the pendulum or swinging movements of the scissor structure. In this manner there is provided a simple, functionally reliable selvedge cutting device possessing a high cutting capacity or output.

6 Claims, 4 Drawing Figures

FIG. 2
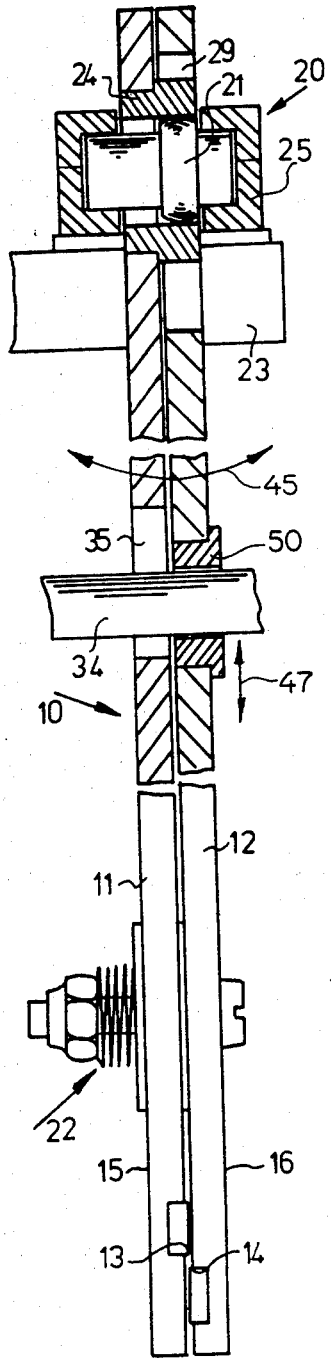
FIG. 3
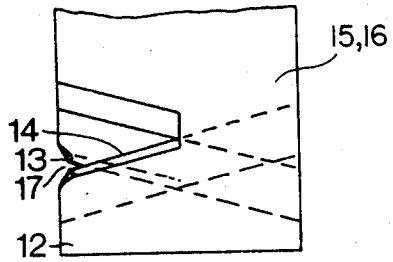
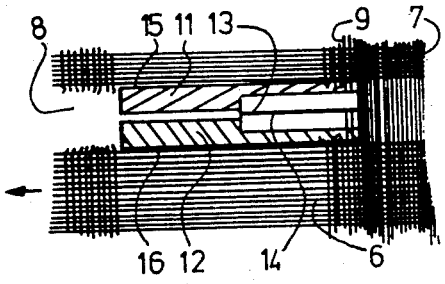
FIG. 4

SELVEDGE CUTTING DEVICE FOR A WEAVING MACHINE

BACKGROUND OF THE INVENTION

The present invention relates to a new and improved construction of a selvedge cutting device or cutter for a weaving machine or loom, which serves to cut the selvedge from the fundamental weave or foundation fabric prior to winding-up the same, and is of the type containing a cutter tool guided in the cutting lane or alley at the fabric selvedge.

It is generally known in this technology that, during the fabrication of certain fabrics, it is necessary to cut the so-called selvedge from the fundamental weave or foundation fabric, since the selvedge, during winding-up of the fabric tends to markedly bulge, and thus, can distort the fabric. Consequently, at the warp there is provided, near to the selvedge or edge of the fabric, an intermediate space constituting a so-called cutting alley or lane for accommodating a selvedge cutter which continuously severs the weft or filling threads in such cutting alley or lane.

An appreciable problem which prevails when using this technique resides, however, in the fact that the position of the cutting alley can appreciably vary, for instance during standstill of the weaving machine or due to climatic conditions. When this occurs it is known that such can cause relatively large fluctuations in the fabric width.

To take into account this phenomenon the selvedge cutter must be capable of following such deviations. Heretofore this could not be satisfactorily accomplished with the prior art selvedge cutters.

There is generally known to the art a selvedge cutter, wherein a stationary cutter is oriented or positioned in the cutting alley or lane by means of a leading feeler wheel or roll. However, with this arrangement the cutter is pivotably adjusted in the fabric plane, so that the danger exists that the cutter will cut into the fundamental weave. Apart from the foregoing shortcoming this arrangement cannot be used for denser fabrics, since in this case the feeler wheel does not stay in its track.

With a similar arrangement known in this technology the cutter is additionally driven for obtaining a saw-tooth movement. While such increases the service life of the cutter and improves upon the cutting operation, nonetheless there is required in this case an extremely complicated cutter construction, so that the drive can follow the deflection movements of the cutter along the cutting alley. Apart from the foregoing, in this case there also is present, and for the same reasons, the danger of cutting into the fundamental weave or foundation fabric.

Proposals which have been advanced for maintaining the cutter in the center of the cutting lane or alley through the use of optical control means, have failed because of the attendant high technical expenditure which is required for this purpose, and furthermore, cannot be used at all in those instances where the fabric selvedge serving as the guide edge is frayed.

Additionally, what is disadvantageous with all of the heretofore known arrangements is that the fabric is continuously pressed against the cutter. Consequently, there is hindered the adjustment movements of the cutter and there is accelerated the wear at the cutting edge. While this drawback could be avoided with scissors, the control thereof is difficult to realize, however, owing to the required drive.

SUMMARY OF THE INVENTION

Therefore, with the foregoing in mind it is a primary object of the present invention to provide a new and improved construction of selvedge cutting device for a weaving machine or loom which is not afflicted with the aforementioned drawbacks and limitations of the prior art.

Another and more specific object of the present invention aims at the provision of a selvedge cutter device of the previously mentioned type which, while avoiding the aforementioned drawbacks, is particularly capable of automatically always cutting at the center of the cutting lane or alley, even if the cutting alley alters its position.

Still a further object of the invention is directed to the provision of a selvedge cutting device of the character described which is simple in its construction and design and affords an extremely high cutting efficiency or output.

Yet a further significant object of the present invention is directed to a new and improved construction of selvedge cutter which is extremely simple in construction, economical to manufacture, highly reliable in operation, not readily subject to breakdown or malfunction, and requires a minimum of maintenance and servicing.

Now in order to implement these and still further objects of the invention, which will become more readily apparent as the description proceeds, the cutter tool of the present development is constituted by scissors extending in a substantially vertical plane with respect to the fabric web. The scissors are intended to immerse into the cutting lane or alley at their one end possessing cutting edges and at their other end are suspended in a pendulum or swinging fashion by means of a pendulum or swing bearing. The scissors possess guide surfaces at the region of their cutting edges. These guide surfaces extend essentially parallel to the selvedge and are intended to provide a self-guiding action in the cutting alley or lane.

An advantageous construction of the invention can be realized if the scissors consist of two mutually contacting blades which are movable relative to one another for exerting a cutting movement. The outer surfaces of the blades form the guide surfaces for guiding the scissors in the cutting alley. The cutting edges are formed at the inner side of the scissor blades and at the side extending into the fabric web delimit a catch groove for the threads in the cutting lane which are to be cut. These last-mentioned measures ensure for a maximum number of cuts and an absolutely positive reception of the threads which are to be cut.

An extremely simple and positive construction of the pendulum bearing for the scissors can be realized according to the invention in that, the one scissor blade is suspendingly arranged upon a stationary ball pin or equivalent structure in order to accomplish a pendulum or swing movement parallel to the guide surfaces. The other scissor blade is displaceable in its lengthwise extent relative to the one scissor blade, and both scissor blades are retained together by means of an elastic clamping or holder device.

To ensure for a pre-setting of the selvedge cutter or selvedge cutting device at the relevant cutting alley or lane, it is desirable if the pendulum bearing along with the ball pin are carried by a carriage which can be attached to the machine frame.

The inventive construction of the scissors enables, as an appreciable prerequisite for a positive functioning and simply designed selvedge cutter, the possibility of arranging at the displaceable scissor blade a drive or drive means which does not hinder the pendulum or swing movements of the scissors and imparts to the relevant scissor blade an up-and-down movement.

A particularly simple construction of drive or drive means for the scissors can be realized if the drive contains a to-and-fro moving connecting rod exposed to the action of a restoring or return spring. This connecting rod operatively engages, by means of a pivotal or oscillating lever arrangement, with a control rod at the displaceable scissor blade.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 illustrates, partially in sectional view and on an enlarged scale, the scissors of the selvedge cutter device shown in FIG. 1;

FIG. 3 illustrates the cutting edge region of the scissors in side view and in closed position, and FIG. 4 illustrates in top plan view and in cross-section the cutting edge region of the scissors guided in the cutting alley or lane of a woven fabric or cloth.

DETAILED DESCRIPTION OF THE PREFERRED EMBODIMENTS

Figure 1:
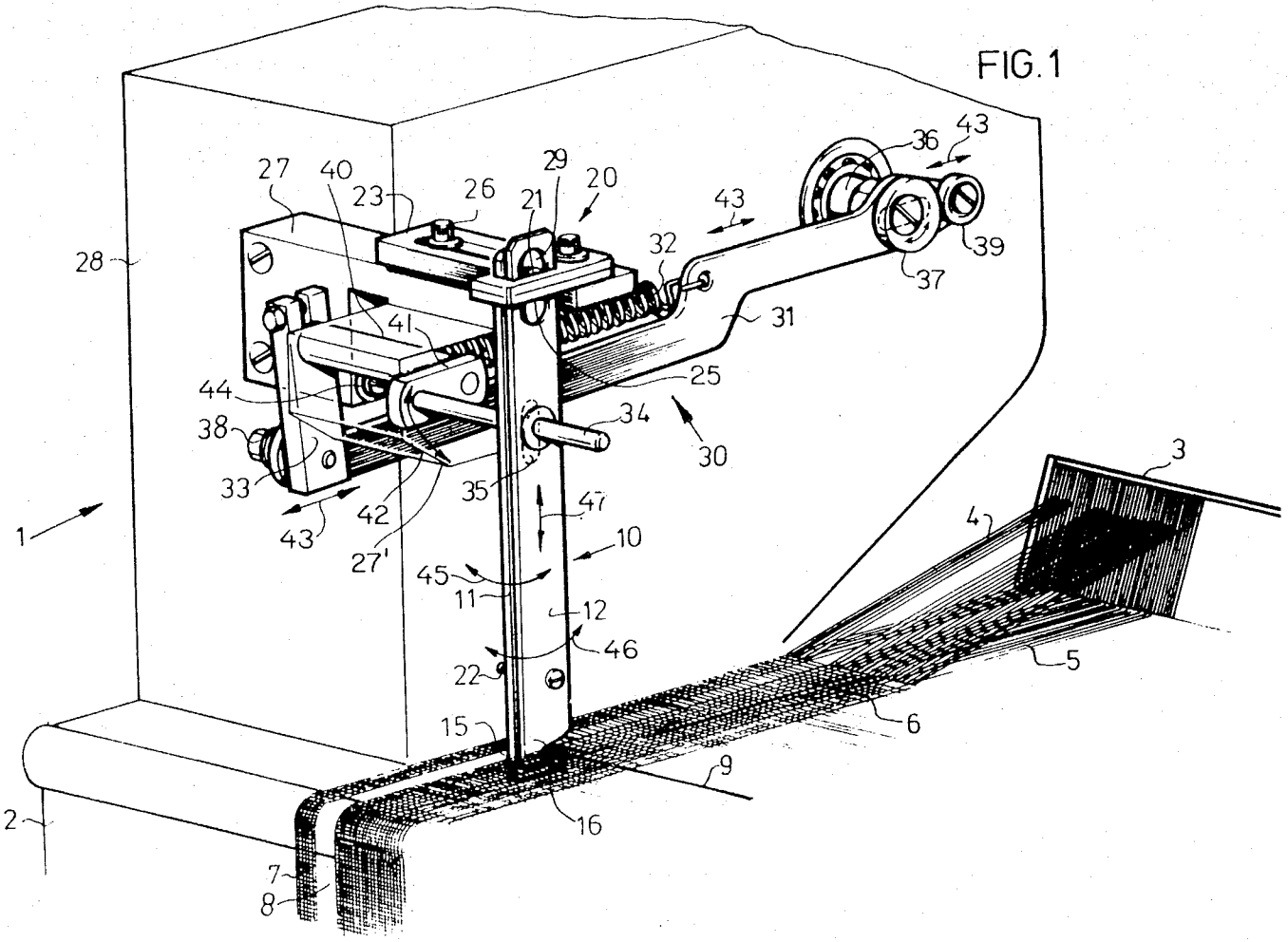
FIG. 1 is a perspective view of selvedge cutter or cutting device, constructed according to the invention, and arranged at a schematically indicated weaving machine or loom.

Describing now the drawings, it is to be understood that only enough of the construction of the weaving loom has been shown as will enable those skilled in this art to readily understand the underlying principles and concepts of the invention, while simplifying the illustration of the drawings. Turning attention now to FIG. 1, there is illustrated therein a selvedge cutting device or cutter 1 which is arranged at the weaving machine frame 2 of a weaving machine or loom, which has only been here generally represented by a sley 3, and serves for severing or cutting the selvedge 7 from the fundamental weave or foundation cloth or fabric 6. This foundation cloth 6 consists of the warp threads of the upper shed 4, the warp threads of the lower shed 5 and the weft or filling threads 9. The separation of the selvedge 7 from the foundation cloth or fundamental weave 6 is accomplished in conventional manner along a cutting alley or lane 8 which is formed near to the edge or selvedge by omitting a number of warp threads.

As contemplated by the invention the selvedge cutter device 1 encompasses scissors 10 which extend in a vertical plane with respect to the woven cloth or fabric 5, and thus, engage by means of their lower end into the cutting lane or alley 8 and are suspended in a pendulum or swinging fashion at their other end by means of a pendulum or swing bearing 20. Considering the construction in greater detail the scissors 10 are formed of two mutually contacting scissor blades 11 and 12. As to the scissor blades 11 and 12 here the inner scissor blade 11 is suspended by means of a bearing eyelet or bushing 24 or equivalent structure and arranged for lateral swinging or pendulum movement upon a stationary ball pin or spherical journal 21 or equivalent structure of the pendulum or swing bearing 20, as the same has been illustrated in greater detail in FIG. 2. The ball pin 21 rests within a cage 25 which is fixedly attached with an adjustment carriage 23 by means of threaded adjustment bolts 26 or the like upon a support or carrier 27 at the gearing or drive housing 28 of the selvedge cutter device 1 and serves for the presetting of the scissors 10 at the related cutting alley or lane 8.

The substantially cylindrical bore of the bearing eyelet or bushing 24 engages the ball pin or spherical journal pin 21 to enable the scissors or scissor structure 10 to pivot freely in the transverse direction, i.e. in the direction across the cutting lane 8 and parallel to the weft threads 9. The pendulum bearing 20 constituted by the bearing eyelet or bushing 24 and the ball pin or spherical journal pin 21 also permits the scissors or scissor structure 10 to pivot in the cutting direction, i.e. in the direction along the cutting lane 8 and parallel to the warp threads 4 and 5. The former, transverse freedom of motion is necessary to permit the scissors or scissor structure 10 to follow a possibly varying location of the cutting lane 8 in the fundamental weave 6, while the latter freedom of motion is incidental to the cutting action and allows the use of a particularly simple drive means for such cutting action.

The outer scissor or cutting blade 12 is displaceably mounted at the pendulum suspended inner scissor or cutting blade 11 in its lengthwise extent, and both scissor blades 11 and 12 are retained together by an elastic clamping or holder device 22 or equivalent structure. An elongate hole or slot 29 at the upper end of the displaceable scissor blade 12 is pierced by the bearing eyelet or bushing 24 and the ball pin 21 of the pendulum bearing or mounting structure 20.

This pendulum suspension of the scissors or scissor structure 10 therefore enables, as the same can be readily recognized by referring to FIG. 4, the scissors to follow every lateral displacement of the fabric web or cloth 6, and thus, allows the scissors 10 to exactly follow the cutting alley or lane 8. To that end, the scissors 10 possess at the region of their cutting edges 13 and 14, which will be described more fully hereinfter, guide surfaces 15 and 16 which extend essentially parallel to the selvedge and are intended to provide a self-guiding action within the cutting alley or lane 8. These guide surfaces 15 and 16 are formed by the outer surfaces of both scissor blades 11 and 12. In operation, they engage the warp threads of the fabric in lateral sliding contact, thus preventing the scissors 10 from leaving the cutting lane 8 formed in the fabric.

FIGS. 2, 3 and 4 illustrate that the cutting edges 13 and 14 are formed at the inner side or inner surface of the scissor blades 11 and 12, respectively. Moreover, at the infeed or contact side of the fabric web 6 these cutting edges 13 and 14 delimit a catch or entrainment groove 17 for the weft threads 9 which are to be separated or severed in each case.

In order to impart to the displaceable, outer scissor blade 12 an up-and-down movement, which does not hinder the pendulum or swinging movement of the scissors 10, and as a general rule during a cutting sequence which is in cycle with the weft thread insertion, there engages at the scissor blade 12 a control rod 34 of a drive or drive means 30 which will be described in greater detail hereinafter. The control rod 34 pierces the inner scissor blade 11 through an elongate hole or slot 35 and is connected with the outer scissor blade 12 such that its pendulum movement in the axial direction of the control rod 34 is not hindered, however the up-and-down movement of the control rod 34 is completely transmitted to the scissor blade 12.

The control rod 34 of the drive or drive means 30 for the scissors 10 and its scissor blade 12 has imparted thereto its up-and-down movement, according to the showing of FIG. 1, by means of a swing or oscillating lever system 33, supported at the aforementioned support or carrier 27, from a connecting rod 31. This connecting rod 31 is subjected to the action of a return or restoring spring 32 and is slidingly seated, at one end, upon a suitable motor driven eccentric shaft 36 and, at the other end, engages by means of a flexible disc or shaft plate 38 at the swing or oscillating lever system 33. The return spring 32 is fastened at its other end to the support 27 by means of a bolt or screw 44.

This produces a simple drive for the scissors 10, which does not hinder the pendulum or swing movements at the scissors 10, as the same will be readily recognized by inspecting FIG. 1.

The eccentric shaft 36 rotates about its axis and entrains an eccentric disc or cam 37 to rotate and engage a roller cam follower 39, thus imparting an oscillating motion to such cam follower 39. The roller cam follower 39 is rotatably mounted on the one end of the connecting rod 31, which, as mentioned above, slidably engages the eccentric shaft 36, thereby guiding the motion of the roller cam follower 39. In such motion, the return spring 33 maintains the roller cam follower 39 in constant engagement with the eccentric disc or cam 37. The oscillating or to-and-fro motion of the connecting rod 31 is transmitted to the oscillating lever 32, causing it to oscillatingly pivot, as is indicated by the arrow 43, about the axis of a rocking or lay shaft 40 journaled in a journal block portion 27' of the support 27. The rocking or lay shaft 40 transmits the oscillatory rotation to a crank arm 41 which is mounted on the rocking or lay shaft 40 at an angle to the mounting of the oscillating lever 33, for instance at approximately 90° thereto. The control rod 34 is mounted in the outer end of the crank arm 41 and thus partakes of the oscillatory motion of the crank arm 41 indicated by the arrow 42.

It will be seen from FIG. 1 that the outer end of the crank arm 41 and with it the control rod 34 perform an arcuate motion which is primarily vertical. It will be seen from FIG. 2 that the control rod 34 engages a bushing 50 in the outer scissor blade 12 and imparts the motion of the control rod 34 thereto. As just mentioned, this motion is primarily vertical and serves to actuate the scissor blade 12, thus effecting the up-and-down cutting action of the scissors or scissor structure 10. The relatively small horizontal component of the arcuate motion 42 of the control rod 34 is also transmitted to the outer scissor blade 12 and causes it to gently oscillate to-and-fro along the cutting lane 8. This motion has no significant effect on the cutting action and permits a relatively simple construction of the drive mechanism. It is generally indicated by the arrow 46 in FIG. 1 and, just as the transverse pivoting motion allowing the scissors or scissor structure 10 to track or follow the location of the cutting lane 8 and generally indicated by the arrow 45 in FIG. 1, is enabled by the pendulum bearing 20.

Of course, within the framework and teachings of the invention there are possible a number of changes, without departing in any way from the underlying principles and concepts of the present development. Thus, for instance, the inner scissor blade could be moved up-and-down; the pendulum suspension could be accomplished for instance by means of a leaf or blade spring, or the drive for the scissors could encompass other means, for instance, eccentric discs and the like.

Independent of the foregoing modifications and still possibly others, there is realized with the heretofore described construction of selvedge cutter a selvedge cutter which, in comparison to the heretofore known constructions, is now capable of reliably and satisfactorily fulfilling all of the previously discussed requirements.

While there are shown and described present preferred embodiments of the invention, it is to be distinctly understood that the invention is not limited thereto, but may be otherwise variously embodied and practiced within the scope of the following claims. Accordingly,

What we claim is:

1. A selvedge cutting device for a weaving machine for severing the selvedge from the foundation fabric prior to winding-up such fabric, comprising:

a cutter device guided in a cutting alley at the selvedge of the fabric;

said cutter device comprising scissors extending in a substantially vertical plane with respect to the woven fabric;

said scissors having opposed end regions;

one of said end regions possessing cutting edges and being intended to immerse into the cutting alley;

pendulum bearing means for swingingly suspending the other end region of said scissors;

said scissors containing guide surfaces at the region of their cutting edges; and said guide surfaces extending substantially parallel to the selvedge and being intended for the self-guiding of the scissors in the cutting alley.

2. The selvedge cutting device as defined in claim 1, wherein:

said scissors comprise two mutually contacting scissor blades;

said scissor blades being movable relative to one another for executing a cutting movement;

said scissor blades having outer surfaces defining said guide surfaces;

said cutting edges being formed at the inside of said scissor blades; and said scissor blades delimiting at a side thereof coming into contact with the fabric a catch groove for the threads which are to be cut and located in the cutting alley.

3. The selvedge cutting device as defined in claim 2, wherein:

said pendulum bearing means comprises stationary ball pin means at which there is suspended one of the scissor blades for accomplishing a pendulum movement essentially transversely with respect to said guide surfaces;

the other scissor blade being displaceable in its lengthwise extent relative to said one scissor blade; and elastic clamping means for retaining together both of said scissor blades.

4. The selvedge cutting device as defined in claim 3, further including:

a machine frame;

carriage means attachable at said machine frame; and said pendulum bearing means and said ball pin means being supported by said carriage means.

5. The selvedge cutting device as defined in claim 3, further including:

drive means operatively engaging with the other displaceable scissor blade; and said drive means imparting to said displaceable scissor blade an essentially up-and-down movement which does not hinder the pendulum movement of the scissors.

6. The selvedge cutting device as defined in claim 5, wherein:

said drive means comprises a to-and-fro oscillating connecting rod;

a return spring acting upon said connecting rod; and a swing lever arrangement containing a control rod by means of which said connecting rod operatively engages with said displaceable scissor blade.

* * * * *